US007273039B2

(12) United States Patent
Ohno et al.

(10) Patent No.: US 7,273,039 B2
(45) Date of Patent: Sep. 25, 2007

(54) CONTROL APPARATUS FOR VEHICULAR INTERNAL COMBUSTION ENGINE

(75) Inventors: Takao Ohno, Tokyo (JP); Akira Furuta, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/327,433

(22) Filed: Jan. 9, 2006

(65) Prior Publication Data

US 2007/0023011 A1 Feb. 1, 2007

(30) Foreign Application Priority Data

Jul. 29, 2005 (JP) ..... P2005-220325

(51) Int. Cl.
*F02D 41/22* (2006.01)

(52) U.S. Cl. ..... 123/479; 73/119 A

(58) Field of Classification Search ..... 123/479, 123/482, 490, 494, 198 D; 73/118.1, 119 A
See application file for complete search history.

(56) References Cited

U.S. PATENT DOCUMENTS 6,044,823 A * 4/2000 Watanabe ..... 123/490
6,732,708 B2 * 5/2004 Nishizawa et al. .... 123/406.13
6,834,640 B2 * 12/2004 Nishizawa et al. .... 123/406.13
7,168,413 B2 * 1/2007 Oono ..... 123/479

FOREIGN PATENT DOCUMENTS

JP 2000-73840 A 3/2000

* cited by examiner

*Primary Examiner*—Hai Huynh
(74) *Attorney, Agent, or Firm*—Sughrue Mion, PLLC

(57) ABSTRACT

In a case where fuel injection system abnormality is detected, and fuel supply stop processing is carried out against the abnormality, since a judgment is made using a misfire judgment, in a case where the misfire judgment is carried out in a periodic measurement system, the reliability is low at the time of a periodic variation or in a low rotation region, and in a case where it is carried out in an ion detection system, the cost increases, and the calculation load of an internal combustion engine control apparatus by the misfire judgment processing increases. A control apparatus for a vehicular internal combustion engine of the invention includes an injector drive abnormality judgment unit to judge, based on an injector drive confirmation signal, drive abnormality of an injector corresponding to the injector drive confirmation signal, and the injector drive abnormality judgment unit judges abnormality of the injector drive confirmation signal based on a state of the injector drive confirmation signal.

5 Claims, 5 Drawing Sheets

CONTROL APPARATUS FOR VEHICULAR INTERNAL COMBUSTION ENGINE

BACKGROUND OF THE INVENTION

1. Field of the Invention

The present invention relates to a control apparatus for a vehicular internal combustion engine, and particularly to a control apparatus for a vehicular internal combustion engine, which controls torque generated by an internal combustion engine by directly injecting fuel into a cylinder of the internal combustion engine.

2. Description of the Related Art

In recent years, in an internal combustion engine mounted in an automobile, in order to improve fuel consumption or the like, a direct-injection internal combustion engine in which fuel is directly injected into a combustion chamber of a cylinder by an injector is proposed and is put to practical use. In the direct-injection internal combustion engine, because of restrictions of pressure in a cylinder, a fuel injection period, a fuel atomization period and the like, fuel pressure is set to be higher than that of a conventional port injection internal combustion engine. The injector to inject the high pressure fuel has a large drive current and requires a drive circuit to control the large current.

In this type of conventional apparatus, an injector drive circuit is provided separately from an internal combustion engine control apparatus, an injector drive signal is transmitted from the internal combustion engine control apparatus to the injector drive circuit, and the, driving of the injector is controlled by the injector drive circuit in accordance with the injector drive signal. Besides, in accordance with a request for the practice of self diagnosis in an internal combustion engine control system, it is detected whether a drive current flows to an injector in synchronization with an injector drive signal, and failure of a fuel injection system is diagnosed based on the detection result (see, for example, patent document 1: JP-A-2000-73840 (pages 1 to 5, FIGS. 1 to 7).

In this conventional apparatus, in order to avoid such a problem that in a case where a signal line to transmit an abnormality diagnosis signal goes wrong (opened or shorted), although fuel injection can be normally carried out, it is judged that a fuel injection system goes wrong, and vehicle traveling is carelessly stopped, the internal combustion engine control apparatus detects the existence of a misfire at every cylinder, and in the case where the misfire is not detected although the abnormality diagnosis signal to indicate the abnormality of the fuel injection system is outputted, an energization signal to each cylinder is continuously outputted, and the fuel injection is continued.

However, according to the conventional apparatus as stated above, in the case where the abnormality of the fuel injection system is detected, and a fuel supply stop processing against the abnormality is carried out, since the judgment is made using the misfire judgment, in the case where the misfire judgment is carried out in a periodic measurement system, the reliability is low at the time of a period variation or in a low rotation region, and in the case where it is carried out in an ion detection system, an increase in cost is caused. Further, an increase in calculation load of the internal combustion engine control apparatus due to the misfire judgment processing is also conceivable.

Besides, the misfire is not necessarily generated by injector drive abnormality. In general, the connection from the injector drive circuit to the injector is such that the power supply side to the injector is common to group cylinders, and the GND side is independent in each cylinder. Thus, for example, in the case of a four-cylinder internal combustion engine having a first to a fourth cylinders, in the case where the ground (hereinafter referred to as GND) side harness of the third injector for the third cylinder is GND-shorted, since the power supply side is common to the second and the third injectors for the second and the third cylinders, at the time of driving the normal second injector, current flows to the third injector. Thus, the third injector is also driven at the same time as the second injector, and the second cylinder at the normal drive timing injects fuel, for example, in the intake stroke to cause normal combustion, while the third injector for the third cylinder injects fuel into the third cylinder in the expansion stroke. In the third cylinder, since the injection of the fuel occurs in the expansion stroke, a misfire signal is not detected, however, there arises a problem that the combustion is delayed, or the fuel flows out to the exhaust system.

SUMMARY OF THE INVENTION

In view of the problems of the conventional apparatus as stated above, the invention provides a control apparatus for a vehicular internal combustion engine in which in a case where abnormality of a fuel injection system occurs, only an injector drive confirmation signal is used, and it is judged whether driving of an injector is abnormal or the injector drive confirmation signal is abnormal, and in the case where the injector drive confirmation signal is abnormal, it is avoided that fuel supply is carelessly stopped, and in the case where the driving of the injector is abnormal, a problem that combustion is delayed or fuel flows out to an exhaust system can be avoided.

A control apparatus for a vehicular internal combustion engine of this invention includes plural injectors which are provided correspondingly to plural cylinders of an internal combustion engine and are driven by drive currents to inject fuel into the corresponding cylinders, an injector drive circuit to supply the drive currents to the plural, injectors, an injector control unit to supply injector drive signals, which control the drive currents, to the injector drive circuit, an injector drive detection unit to generate injector drive confirmation signals corresponding to drivings of the plural injectors, and an injector drive abnormality judgment unit to judge, based on the injector drive confirmation signal, a drive abnormality of the injector corresponding to the injector drive confirmation signal, and the injector drive abnormality judgment unit judges an abnormality of the injector drive confirmation signals based on a state of the injector drive confirmation signals.

Besides, the control apparatus for the vehicular internal combustion engine according to the invention is constructed such that the injector drive abnormality judgment unit judges the state of the injector drive confirmation signals based on existence of a past injector drive signal corresponding to the injector drive signal generated from the injector control unit, and judges the abnormality of the injector drive confirmation signals.

Further, the control apparatus for the vehicular internal combustion engine according to the invention is constructed such that the injector drive detection unit outputs the injector drive confirmation signal in synchronization with the injector drive signal by the injector control unit.

Further, the control apparatus for the vehicular internal combustion engine according to the invention is constructed such that the injector drive detection unit generates the injector drive confirmation signal based on a serge voltage at a time of stop of the drive current supplied to the injector by the injector drive circuit.

Besides, the control apparatus for the vehicular internal combustion engine according to the invention is constructed such that the injector drive abnormality judgment unit judges that when the injector drive confirmation signal is missed, the injector corresponding to the injector drive confirmation signal is abnormal in driving, and judges that when all the injector drive confirmation signals corresponding to the plural injectors are missed, the injector drive confirmation signals are abnormal.

Further, the control apparatus for the vehicular internal combustion engine according to the invention is constructed such that the injector drive signal from the injector control unit is stopped to stop fuel supply to the target cylinder of the injector judged to be abnormal in driving by the injector drive abnormality judgment unit, and the injector drive signal from the injector control unit is continued and fuel supply to the cylinder is continued when it is judged that the injector drive confirmation signals are abnormal.

Furthermore, the control apparatus of the vehicular internal combustion engine according to the invention is constructed such that when it is judged by the injector drive abnormality judgment unit that the injector is abnormal in driving, the injector control unit stops output of the injector drive signal of the cylinder of a group to which the target cylinder of the injector judged to be abnormal in driving belongs.

As described above, the control apparatus for the vehicular internal combustion engine according to the invention includes the plural injectors which are provided correspondingly to the plural cylinders of the internal combustion engine and are driven by the drive currents to inject the fuel into the corresponding cylinders, the injector drive circuit to supply the drive currents to the plural injectors, the injector control unit to supply the injector drive signals, which control the drive currents, to the injector drive circuit, the injector drive detection unit to generate the injector drive confirmation signals corresponding to the drivings of the plural injectors, and the injector drive abnormality judgment unit to judge, based on the injector drive confirmation signal, the drive abnormality of the injector corresponding to the injector drive confirmation signal. The injector drive abnormality judgment unit judges the abnormality of the injector drive confirmation signals based on the state of the injector drive confirmation signals, and therefore, the detection of the drive abnormality of the injector and/or the abnormality of the injector drive confirmation signals can be easily judged by using only the injector drive confirmation signals indicating the drive states of the injectors.

Besides, the control apparatus for the vehicular internal combustion engine according to the invention is constructed such that the injector drive abnormality judgment unit judges the state of the injector drive confirmation signals based on the existence of the past injector drive signal corresponding to the injector drive signal generated from the injector control unit, and judges the abnormality of the injector drive confirmation signals, and therefore, the abnormality of the injector drive confirmation signals can be certainly and easily judged.

Further, the control apparatus for the vehicular internal combustion engine according to the invention is constructed such that the injector drive detection unit outputs the injector drive confirmation signal in synchronization with the injector drive signal by the injector control unit, and therefore, the target cylinder can be certainly specified from the injector drive confirmation signal.

Further, the control apparatus for the vehicular internal combustion engine according to the invention is constructed such that the injector drive detection unit generates the injector drive confirmation signal based on the serge voltage at the time of stop of the drive current supplied to the injector by the injector drive circuit, and therefore, the injector drive confirmation signal accurately corresponding to the drive state of the injector can be obtained.

Besides, the control apparatus for the vehicular internal combustion engine according to the inventions is constructed such that the injector drive abnormality judgment unit judges that when the injector drive confirmation signal is missed, the injector corresponding to the injector drive confirmation signal is abnormal in driving, and judges that when all the injector drive confirmation signals corresponding to the plural injectors are missed, the injector drive confirmation signals are abnormal, and therefore, the drive abnormality of the injector and the abnormality of the injector drive confirmation signals can be certainly judged by only the injector drive confirmation signals.

Further, the control apparatus for the vehicular internal combustion engine according to the invention is constructed such that the injector drive signal from the injector control unit is stopped to stop the fuel supply to the target cylinder of the injector judged to be abnormal in driving by the injector drive abnormality judgment unit, and the injector drive signal from the injector control unit is continued and the fuel supply to the cylinder is continued when it is judged that the injector drive confirmation signals are abnormal, and therefore, in the case where the injector drive confirmation signals are abnormal, it is avoided that the fuel supply is carelessly stopped, and in the case where the injector is abnormal in driving, the fuel supply to the target cylinder of the injector is stopped, and it is possible to avoid the problem that the combustion is delayed or the fuel flows out to the exhaust system.

Furthermore, the control apparatus of the vehicular internal combustion engine according to the invention is constructed such that when it is judged by the injector drive abnormality judgment unit that the injector is abnormal in driving, the injector control unit stops the output of the injector drive signal of the cylinder of the group to which the target cylinder of the injector judged to be abnormal in driving belongs, and therefore, it is possible to avoid simultaneous fuel injection of the group cylinder, and the safe internal combustion engine control apparatus can be obtained.

DETAILED DESCRIPTION OF THE PREFERRED EMBODIMENTS

Embodiment 1

Figure 1:
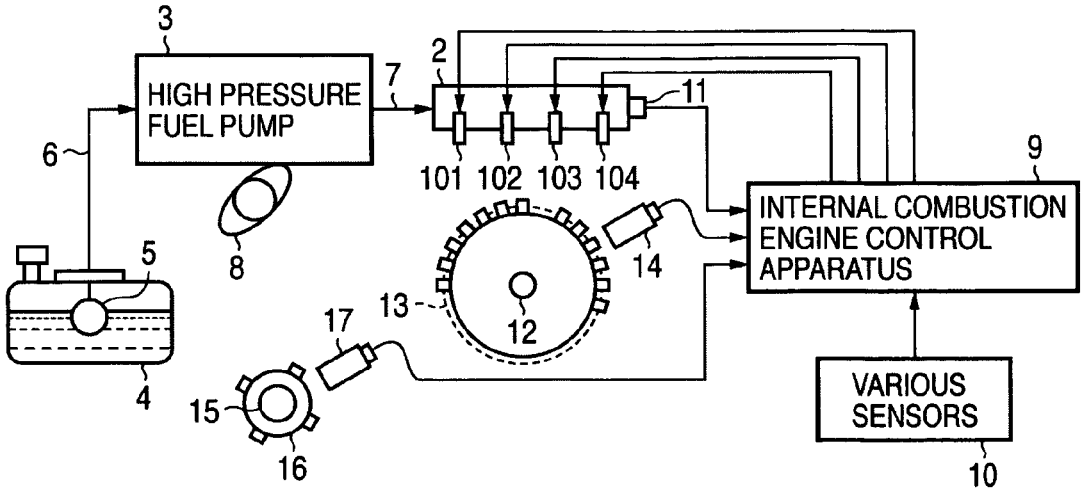
FIG. 1 is a structural view showing a control apparatus for a vehicular internal combustion engine according to embodiment 1 of the invention.
Figure 2:
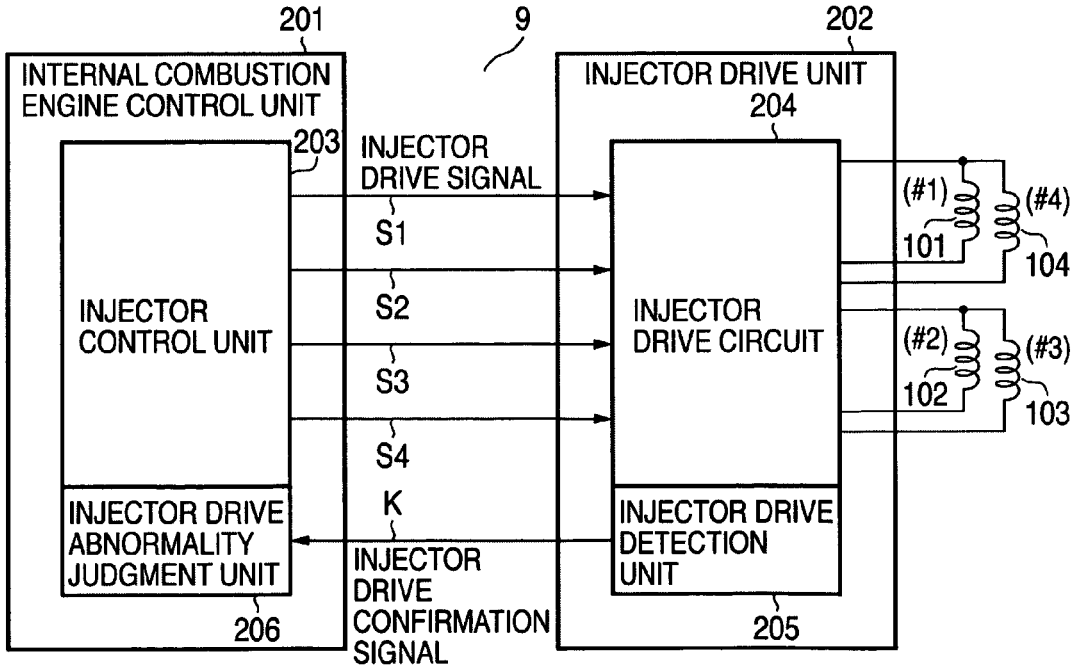
FIG. 2 is a structural view of a main part of the control apparatus for the vehicular internal combustion engine according to embodiment 1 of the invention.
Figure 3:
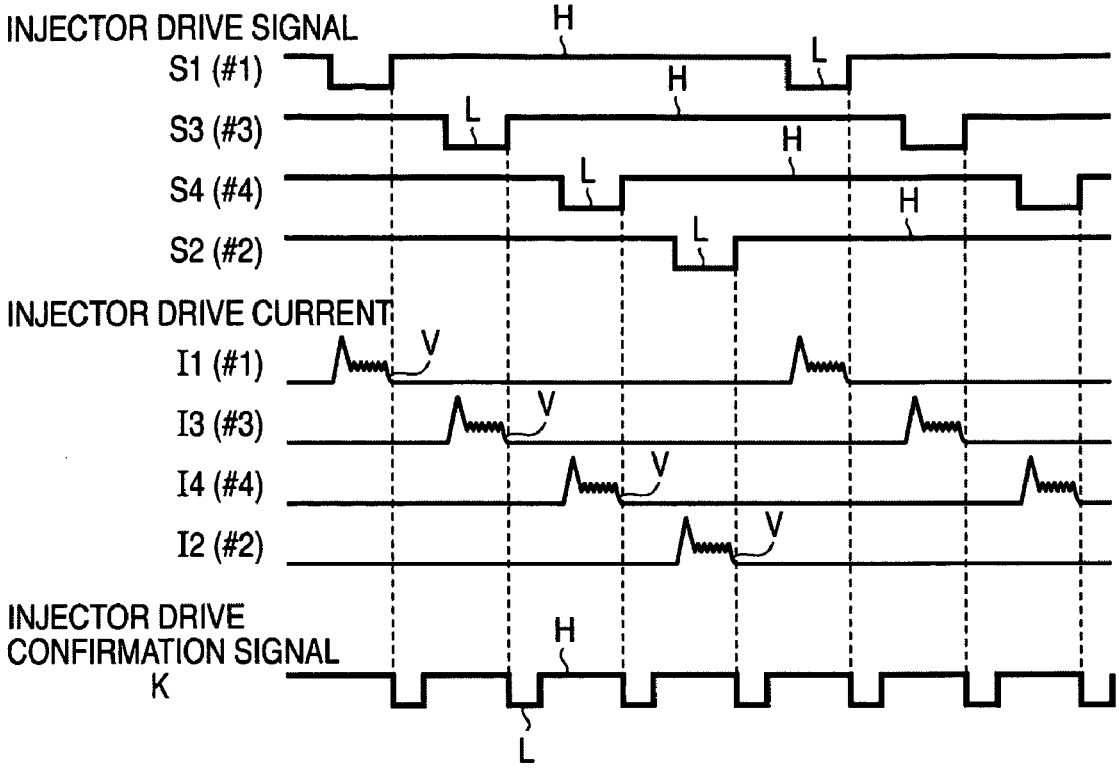
FIG. 3 is a timing chart showing an injector drive confirmation signal of the control apparatus for the vehicular internal combustion engine according to embodiment 1 of the invention.
Figure 4:
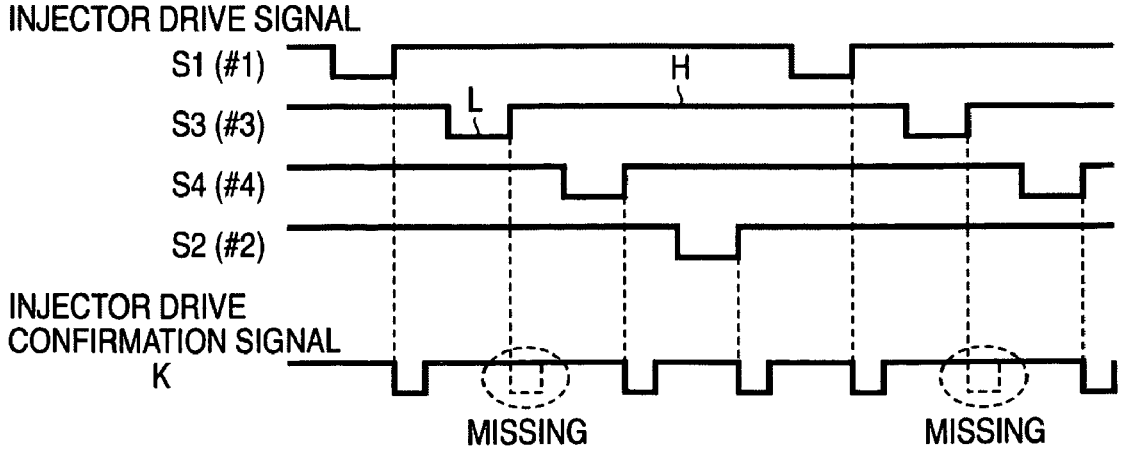
FIG. 4 is a timing chart showing a state of the injector drive confirmation signal, at the time of drive abnormality of an injector, of the control apparatus for the vehicular internal combustion engine according to embodiment 1 of the invention.
Figure 5:
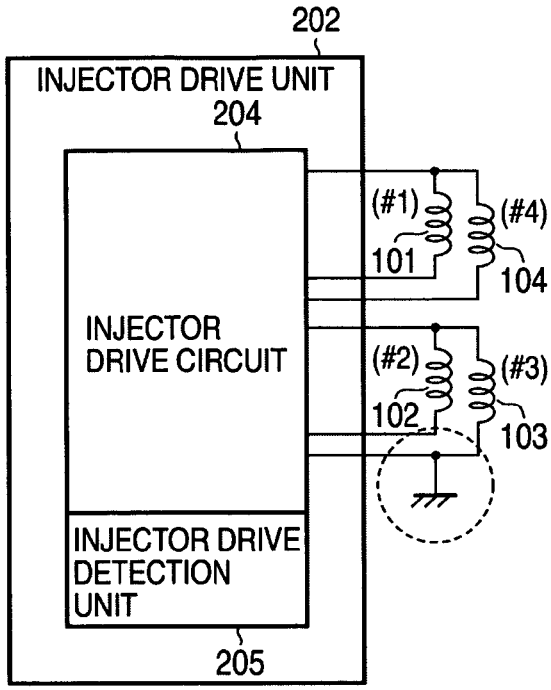
FIG. 5 is an explanatory view showing a failure state between an injector and an injector drive circuit of the control apparatus for the vehicular internal combustion engine according to embodiment 1 of the invention.
Figure 6:
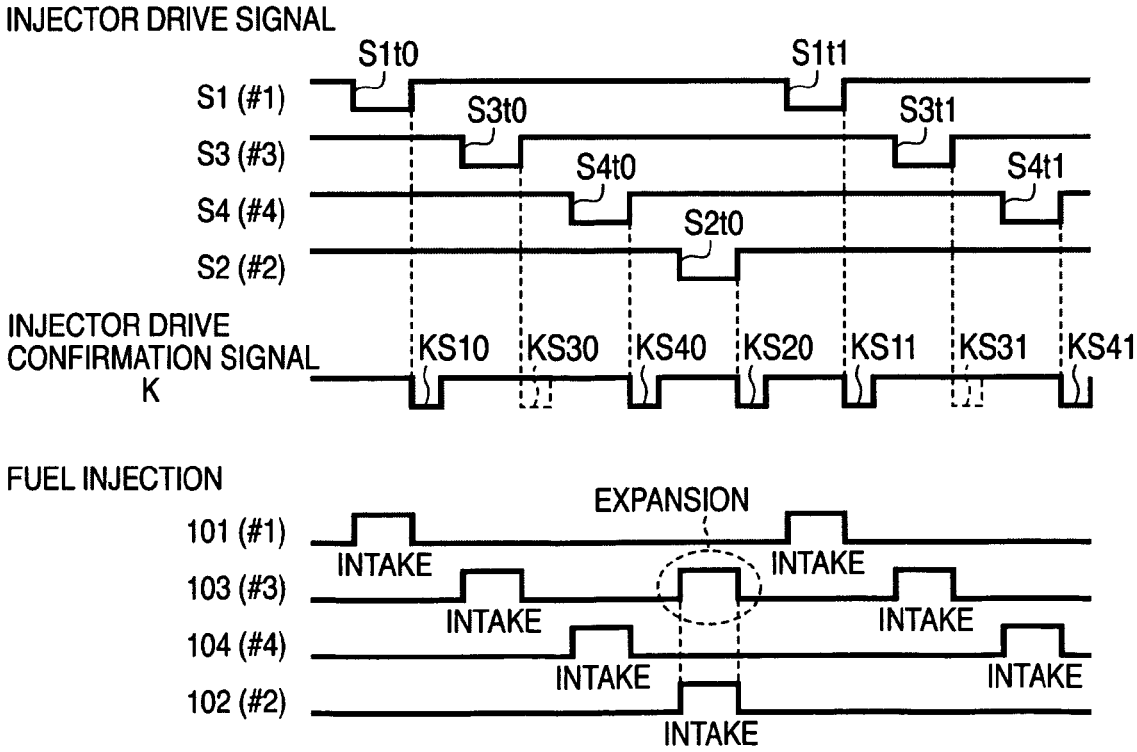
FIG. 6 is a timing chart showing respective signals at the time of failure between the injector and the injector drive circuit of the control apparatus for the vehicular internal combustion engine according to embodiment 1 of the invention.
Figure 7A:
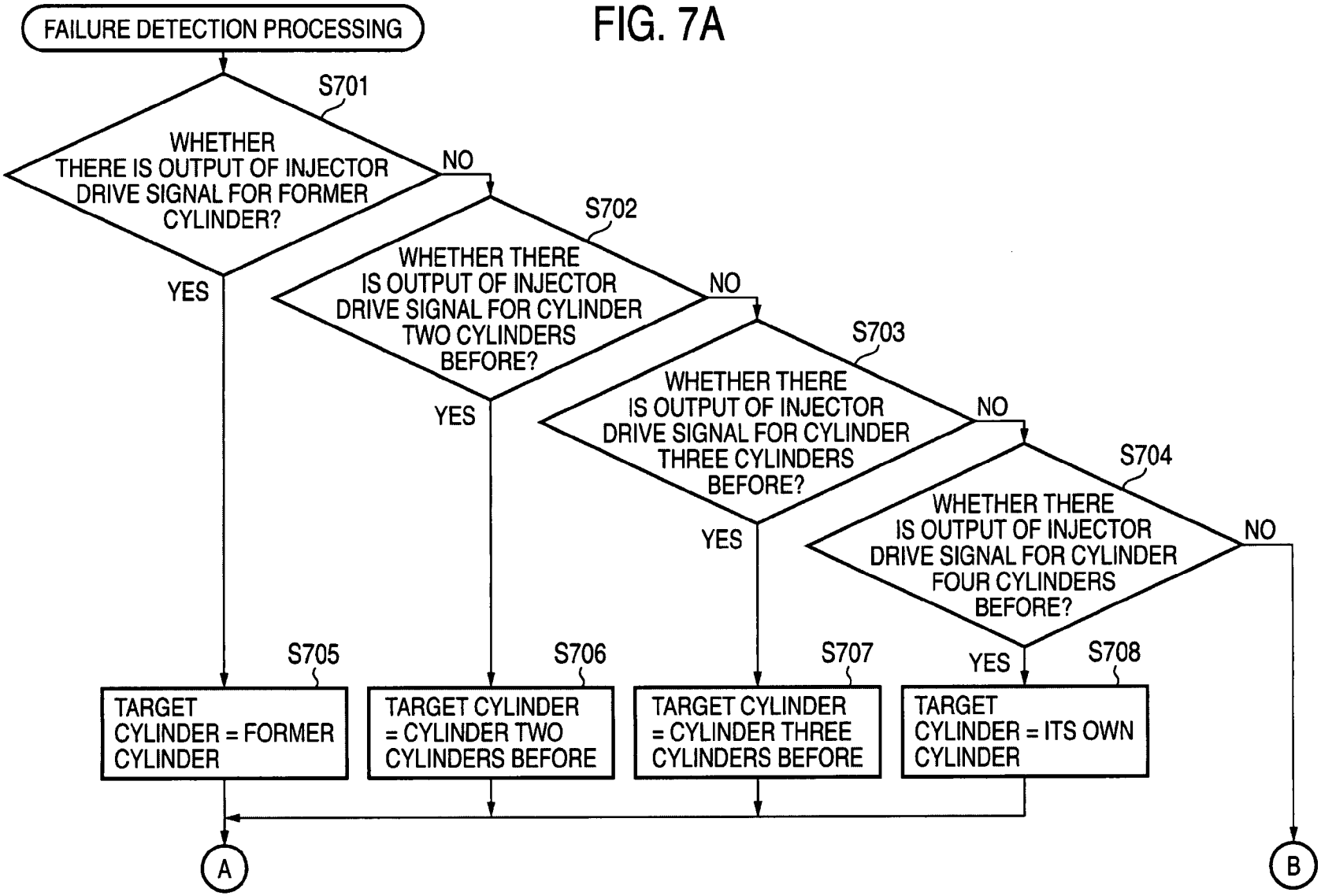
FIG. 7A and FIG. 7B are flowchart charts for explaining an abnormality judgment operation by an injector drive abnormality judgment unit of the control apparatus for the vehicular internal combustion engine according to embodiment 1 of the invention.
Figure 7B:
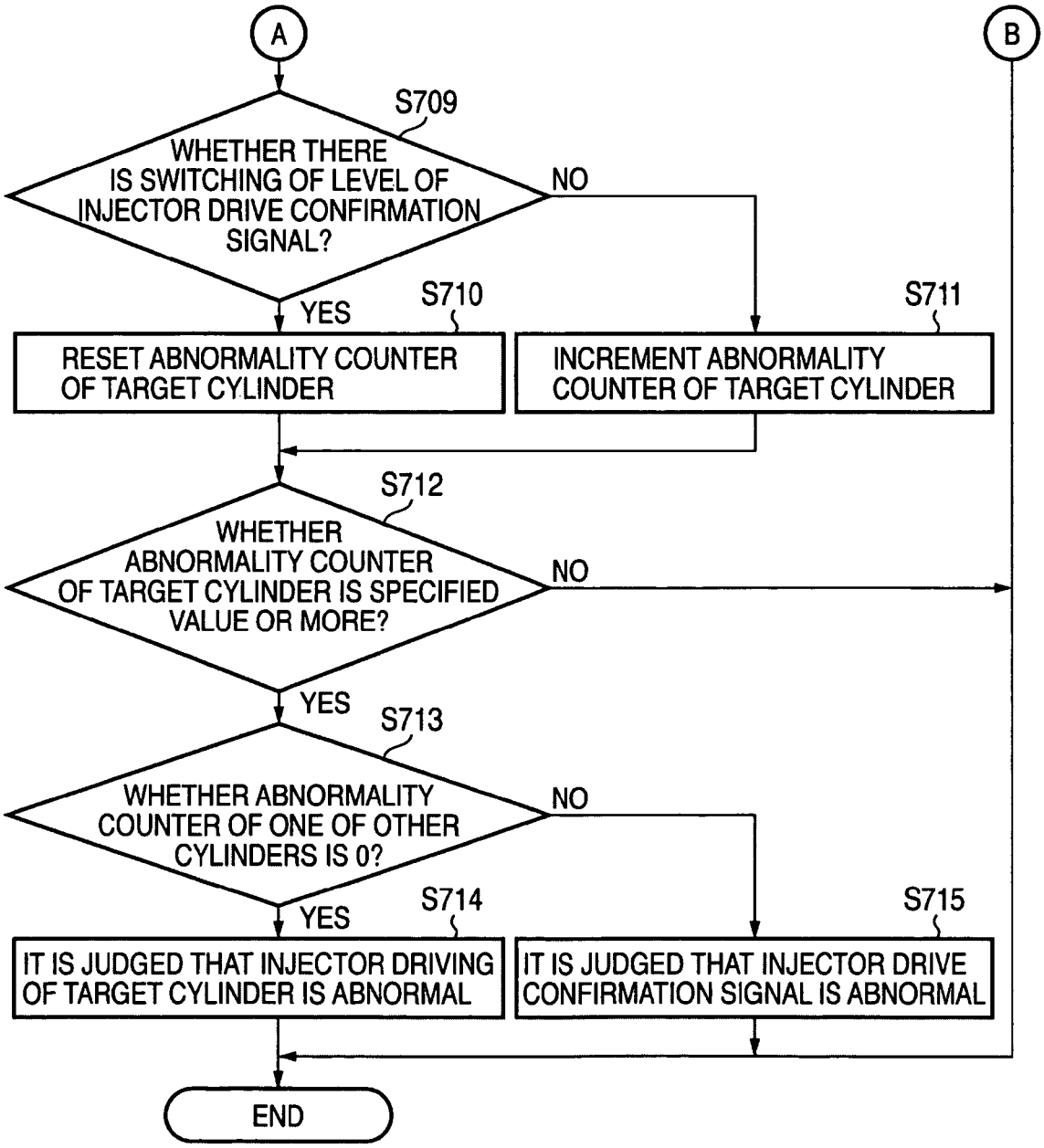

FIGS. 1 to 7A and 7B show a control apparatus for a vehicular internal combustion engine according to embodiment 1 of the invention, FIG. 1 is a structural view, FIG. 2 is a structural view of its main part. FIG. 3 is a timing chart showing an injector drive confirmation signal, FIG. 4 is a timing chart showing a state of the injector drive confirmation signal at the time of drive abnormality of an injector, FIG. 5 is an explanatory view showing a failure state between an injector and an injector drive circuit, FIG. 6 is a timing chart showing respective signals at the time of failure between the injector and the injector drive circuit, and FIG. 7 is a flowchart chart for explaining an abnormality judgment operation by an injector drive abnormality judgment unit.

In FIG. 1, first to fourth cylinders (not shown) of a four-cylinder internal combustion engine are provided with first to fourth injectors 101, 102, 103 and 104 to directly inject fuel into the respective cylinders, and these injectors 101, 102, 103 and 104 are connected to a common fuel pipe 2. The common fuel pipe 2 has a function to store pressurized fuel supplied from a high pressure fuel pump 3 and to distribute the fuel to the respective injectors 101 to 104. During the operation of the internal combustion engine, the pressure of fuel in a fuel tank 4 is raised to a specific pressure by a low pressure feed pump 5, and is supplied to the high pressure fuel pump 3 through a low pressure pipe 6. The high pressure fuel pump 3 is driven by a pump drive cam 8, and pressure-sends the fuel to the common fuel pipe 2 through a high pressure pipe 7. The high pressure fuel supplied to the fuel pipe 2 is injected into the respective cylinders by the respective injectors 101 to 104.

Signals from various sensors 10 to indicate a load state of the internal combustion engine and states of the internal combustion engine, and a signal from a fuel pressure sensor 11 to detect fuel pressure in the common fuel pipe 2 are inputted to an internal combustion engine control apparatus 9 to control the internal combustion engine. A crank angle sensor 14 is placed in the vicinity of a crank angle detection member 13 provided on a crank shaft 12 of the internal combustion engine, and the crank angle sensor 14 generates a reference pulse signal when the crank shaft 12 is located at a reference rotation position, and generates a rotation pulse signal corresponding to the rotation angle of the crank shaft 12.

The reference pulse signal and the rotation pulse signal generated by the crank angle sensor 14 are inputted to the internal combustion engine control apparatus 9. Further, a cam angle sensor 17 is placed in the vicinity of a cam angle detecting member 16 provided on a cam shaft 15, and the cam angle sensor 17 generates the cam pulse each time the cam shaft 15 is located at the reference rotation position. The cam pulse signal generated by the cam angle sensor 17 is inputted to the internal combustion engine control apparatus 9.

The internal combustion engine control apparatus 9 performs cylinder discrimination based on the reference pulse signal and the rotation pulse signal inputted from the crank angle sensor 14 and the cam pulse signal from the cam angle sensor 17, and further, calculates control amounts to control the internal combustion engine based on the input signals of the other respective sensors, and controls the injectors or not-shown ignition coils, and respective actuators such as throttles, so that the driving of the internal combustion engine is carried out.

In FIG. 2 showing the structure of the internal combustion engine control apparatus 9, the structure includes an internal combustion engine control unit 201 which calculates the control amounts to control the combustion engine based on the signals inputted from the respective sensors and controls the actuators, and an injector drive unit 202 to control the driving of the injectors.

The internal combustion engine control unit 201 includes a well-known CPU, ROM, RAM, backup RAM, input/output interface and the like. Besides, there is included an injector control unit 203 to calculate drive times and drive timings of the injectors 101, 102, 103 and 104 based on the signals inputted from the respective sensors. The injector control unit 203 outputs injector drive signals S1, S2, S3 and S4 to an injector drive circuit 204 of the injector drive unit 202 based on the calculated result.

The injector drive circuit 204 included in the injector drive unit 202 controls drive currents of the corresponding injectors 101, 102, 103 and 104 based on the injector drive signals S1, S2, S3 and S4 from the injector control unit 203 and drives the respective injectors. In the internal combustion engine of this embodiment, the combustion stroke advances in the order of the first cylinder→third cylinder→fourth cylinder→second cylinder, and with respect to group cylinders, there are two groups, that is, the group of the first cylinder and the fourth cylinder and the group of the second cylinder and the third cylinder. In the drawing, #1 to #4 are respectively attached to the first cylinder to the fourth cylinder as targets.

The connection between the injector drive circuit 204 and the injectors 101, 102, 103 and 104 is constructed in such a form that the power supply side is common to the first injector 101 and the fourth injector 104, and the GND side is independent in the respective cylinders. Similarly, the power supply side is common to the second injector 102 and the third injector 103, and the GND side is independent in the respective cylinders.

Further, the injector drive unit 202 includes an injector drive detection unit 205 which judges whether driving of the respective injectors 101, 102, 103 and 104 by the injector drive circuit 204 is normally performed and outputs an injector drive confirmation signal K in the case where it is normally performed. The injector drive detection unit 205 in this embodiment outputs the injector drive confirmation signal K by an off surge voltage generated when the drive current of each of the injectors 101, 102, 103 and 104 is turned off by the injector drive circuit 204.

Specifically, a terminal voltage at the time when a GND side injector driving transistor (not shown), which is included in the injector drive circuit 204 and controls the injector of each cylinder, is turned off is compared with a specified threshold, and in the case where the terminal voltage exceeds the threshold, a rectangular wave is outputted as the injector drive confirmation signal K. Incidentally, the injector drive circuit may be a well-known circuit as shown in, for example, FIG. 2 of patent document 1.

In a chart of output timing of the injector drive confirmation signal K shown in FIG. 3, the injector drive signals S1, S2, S3 and S4 are outputted to the injector drive circuit 204 for the respective cylinders by the injector control unit 203, and when each of the signals does not drive the injector, the signal becomes high level H, and when driving the injector, the signal becomes low level L. Injector drive currents I1, I2, I3 and I4 are outputted to the injectors 101, 102, 103 and 104 by the injector drive circuit 204, and drive the respective injectors. The injector drive confirmation signal K is outputted by the injector drive detection unit 205.

In the injector drive confirmation signal K, in the case where an off surge voltage V, which is generated when the passage of current to each of the injectors 101, 102, 103 and 104 is stopped, is generated, the signal is made the low level L, and in the other case, the high level H is outputted. Accordingly, as shown in FIG. 4, for example, in the case where the off surge voltage is not generated when the injector drive signal S3 of the third injector 103 is changed from the low level L to the high level H and the driving is turned off, that is, in the case where the driving of the third injector 103 is not normally performed, the injector drive confirmation signal K remains at the high level H at the end of the driving of the third cylinder, and there occurs a state where the signal of the low level L is missed.

Here, a failure mode in which the signal of the low level L of the injector drive confirmation signal K is missed will be described.

The failure mode in which the signal of the low level L is missed has following four items.

(1) Missing of the injector drive signal due to disconnection or the like.

(2) Disconnection of a power supply side harness between the injector drive circuit and the injector, or disconnection of a GND side harness between the injector and the injector drive circuit.

(3) GND short of the GND side harness between the injector and the injector drive circuit (4) Disconnection or short of the signal line to transmit the injector drive confirmation signal.

Among these items, in the item (1), there occurs a state in which at least one of the injector drive signals S1, S2, S3 and S4 is not inputted to the injector drive circuit 204, and in the item (2), the injector drive current to the injector relating to the disconnection can not be controlled. Thus, both the items (1) and (2) become the failure state in which fuel can not be injected from the injector.

Next, the case of the item (3) will be described with reference to FIGS. 5 and 6. FIG. 5 shows a state in which the GND side harness between the third injector 103 and the injector drive circuit 204 is GND-shorted and goes wrong. In the case where this failure occurs, when the second injector 102 is driven, the injector drive current flows also to the third injector 103 sharing the common power side, and the third injector 103 operates at the same time as the second injector 102.

FIG. 6 is a chart showing the injector drive signals S1, S2, S3 and S4, the injector drive confirmation signal K, and the states of fuel injection of the injectors 101, 102, 103 and 104 at the time when the GND harness between the third injector 103 and the injector drive circuit 204 is GND-shorted and goes wrong. As shown in FIG. 6, with respect to the normal injectors 101, 102 and 104, as the injector drive confirmation signal K, a signal is outputted which becomes the low level at the time point when the low level of each of the injector drive signals S1, S2 and S4 comes to an end. However, at the time point of the driving end of the third injector 103, since the GND side harness is GND-shorted, the off surge voltage V is not detected, and accordingly, the injector drive confirmation signal K remains at the high level, and a low level signal is not outputted.

In the failure state of the item (3), since the third injector 103 is also driven at the timing when the normal second injector 102 is driven, when the intake stroke of the internal combustion engine is performed at the normal injection timing, the third injector 103 makes injection in the expansion stroke, and the combustion is delayed, or the fuel flows out to the exhaust system, and the disadvantageous state occurs.

With respect to the failure of the item (4), the injector drive confirmation signal K always becomes the high level or the low level. The fuel injection by the injector in this failure state is normally carried out as long as a double failure including another failure state does not occur.

In order to judge the abnormal state of the injector driving based on the injector drive confirmation signal K from the injector drive detection unit 205, the internal combustion engine control unit 201 includes an injector drive abnormality judgment unit 206. The injector drive abnormality judgment unit 206 detects the existence of switching from the high level to the low level of the injector drive confirmation signal K, and judges whether the injector driving is in a normal state or an abnormal state.

Specifically, at each timing when the injector control unit 203 outputs the injector drive signals S1, S2, S3 and S4, the injector drive abnormality judgment unit 206 detects whether level switching from high to low occurs in the injector drive confirmation signal K from the injector drive detection unit 205 during a period from the last output of the injector drive signal to this output of the injector drive signal. That is, now, in FIG. 6, when attention is paid to the first injector 101, when S1t1 is outputted as the injector drive signal S1 at this time, it is confirmed that KS10 is generated as the injector drive confirmation signal K during the period from the last output of S1t0 to this output of S1t1, and the injector drive abnormality judgment unit 206 judges that the first injector 101 is normally driven.

Next, when attention is paid to the third injector 103, when S3t1 is outputted as the injector drive signal S3 at this time, it is confirmed that KS30, which originally should be generated as the injector drive confirmation signal K, is not generated during the period from the last output of S3t0 to this output of S3t1, the injector drive abnormality judgment unit 206 judges that the third injector 103 is not normally driven, and the driving is abnormal.

Also with respect to the fourth injector 104 and the second injector 102, when an injector drive signal S4t1 at this time and an injector drive signal S2t1 (not shown) are outputted, similarly, it is confirmed whether the injector drive confirmation signal K are generated as KS40 and KS20, and the injector drive abnormality judgment unit 506 judges, based on the existence thereof, whether the drivings of the fourth injector 104 and the second injector 102 are abnormal.

In the case where the injector drive abnormality judgment unit 206 detects the missing of the injector drive confirmation signal corresponding to all the first to fourth cylinders, it is judged that the injector drive confirmation signal K is abnormal, that is, the signal line to transmit the injector drive confirmation signal K is broken or shorted.

When it is judged by the injector drive abnormality judgment unit 206 that driving of one of the injectors is abnormal, the injector control unit 203 stops the injector drive signals of the injector judged to be abnormal in driving and the other injector corresponding to the group cylinder of the target cylinder. By this, at the time of the failure state of the item (3), it becomes possible to avoid the disadvantage that fuel injection into the group cylinder is simultaneously performed.

Besides, in the case where the injector drive abnormality judgment unit 206 detects the missing of the injector drive confirmation signal corresponding to all the first to fourth cylinders, or in the case where it is judged that the injector drive confirmation signal K is abnormal, that is, the signal line to transmit the injector drive confirmation signal K is broken or shorted, the injector control unit 203 continues the output of the injector drive signals S1 to S4, and stores the abnormal state of the injector drive confirmation signal K as failure information.

Next, an abnormal judgment operation using the injector drive confirmation signal, which is carried out by the injector drive abnormality judgment unit 206, will be described with reference toga flowchart of FIG. 7A and FIG. 7B. As described above, the injector drive abnormality judgment unit 206 carries out the injector drive abnormality judgment processing in synchronization with the timing when the injector control unit 203 outputs the injector drive signals S1, S2, S3 and S4.

First, in the process of steps S701 to S708, it is judged that the injector drive confirmation signal from the injector drive detection unit 205 indicates the drive state of the injector for which cylinder. That is, at step S701, it is confirmed whether there is output of the injector drive signal for the former cylinder, and in the case where there is output, advance is made to step S705, and it is judged that the target cylinder of the injector drive confirmation signal is the former cylinder. In the case where it is confirmed at step S701 that there is no output of the injector drive signal for the former cylinder, advance is made to step S702, and it is confirmed whether there is output of the injector drive signal for the cylinder two cylinders before. In the case where there is output, advance is made to step S706, and it is judged that the target cylinder of the injector drive confirmation signal is the cylinder two cylinders before.

In the case where it is confirmed at step S702 that there is no output of the injector drive signal for the cylinder two cylinders before, advance is made to step S703, and it is confirmed whether there is output of the injector drive signal for the cylinder three cylinders before. In the case where there is output, advance is made to step S707, and it is judged that the target cylinder of the injector drive confirmation signal is the cylinder three cylinders before. In the case where it is confirmed that there is no output of the injector drive signal for the cylinder three cylinders before, advance is made to step S704, and it is confirmed whether there is output of the injector drive signal for the cylinder four cylinders before. In the case where there is output, advance is made to step S708, and it is judged that the target cylinder of the injector drive confirmation signal is this cylinder, that is, its own cylinder. In the case where it is confirmed that there is no output of the injector drive signal for the cylinder four cylinders before, the injector drive abnormality judgment processing is ended.

Now, when the combustion order of the internal combustion engine is the first cylinder→third cylinder→fourth cylinder→second cylinder, the judgment processing of the target cylinder at steps S701 to S708 is specifically as follows. That is, in FIG. 6, in case the output of the injector drive signal at this time is S4t1 for the fourth cylinder, when there is output of the last injector drive signal S3t1, it is meant that the injector drive confirmation signal is KS31 indicating the drive state of the third injector 103 for the third cylinder, and the target cylinder becomes the third cylinder. When there is no output of the last injector drive signal and there is output of the last but one injector drive signal S1t1, it is meant that the injector drive confirmation signal is KS11 indicating the drive state of the first injector for the first cylinder, and the target cylinder becomes the first cylinder.

Similarly, when there is no output of the last but one injector drive signal and there is output of the last but two injector drive signal S2t0, it is meant that the injector drive confirmation signal is KS20 indicating the drive state of the second injector for the second cylinder, and the target cylinder becomes the second cylinder. When there is no output of the last but two injector drive signal and there is output of the last but three injector drive signal S4t0, it is meant that the injector drive confirmation signal is KS40 indicating the drive state of the fourth injector for the fourth cylinder, that is, its own cylinder, and the target cylinder becomes the fourth cylinder, that is, its own cylinder. In the case where it is judged at step S704 that there is no output of injector drive signal for the last but three cylinder, since it is meant that an all-cylinder fuel drive stop state occurs, the injector drive abnormality judgment processing is not performed.

After the judgment of the target cylinder at step S701 to S708, advance is made to step S709, and it is confirmed whether there is switching of level of the injector drive confirmation signal. In the case where there is switching, it is meant that driving of the injector is normally performed, advance is made to step S710, and an abnormality counter of the target cylinder is reset to 0. In the case where there is no switching, it is meant that injector driving is abnormal, advance is made to step S711, and the abnormality counter of the target cylinder is incremented. With respect to the judgment of the existence of the switching, for example, the existence of input of a signal falling edge from high to low of the injector drive confirmation signal is confirmed after the last injector drive signal is outputted.

Next, advance is made to step S712, and it is judged whether the abnormality counter of the target cylinder has a specified value or more. When it does not have the specified value or more, the abnormality judgment is not made, and the injector drive abnormality judgment processing is ended. In the case where it is judged at step S712 that the abnormality counter has the specified value or more, in order to make a distinction from the abnormality of the injector drive confirmation signal, advance is made to step S713. At step S713, it is confirmed whether one of abnormal counters of the other cylinders is 0. That the one of the abnormal counters of the other cylinders is 0 means that the information that the one of the cylinders normally carries out injector driving can be judged based on the injector drive confirmation signal. That is, the injector drive confirmation signal can output signals of the high level H and the low level L, and it can be judged that the injector drive confirmation signal is not abnormal.

At step S713, when it is confirmed that one of the abnormality counters of the other cylinders is 0, advance is made to step S714, and it is judged that the injector of the target cylinder is abnormal in driving. In the case where it is judged at step S713 that the abnormality counters of any cylinders are not 0, advance is made to step S715, and it is judged that the injector drive confirmation signal is abnormal.

According to embodiment 1 described above in detail, the drive abnormality of the injector, or the abnormality of the injector drive confirmation signal can be judged by using only the injector drive confirmation signal indicating the drive state of the injector. Further, at the time of drive abnormality of the injector, it is possible to avoid simultaneous fuel injection of the group cylinder, and the safe internal combustion engine control apparatus can be obtained.

Besides, although the invention is applied to the direct-injection gasoline internal combustion engine, the invention can also be applied to a port injection gasoline internal combustion engine, a diesel internal combustion engine or the like. Further, although the description has been given to the case where the internal combustion engine control unit and the injector drive unit are separate bodies, even when these are integrated in the same unit, the invention can be similarly applied.

What is claimed is:

1. A control apparatus for a vehicular internal combustion engine, comprising;

plural injectors which respectively target plural cylinders of an internal combustion engine and are driven by drive currents to inject fuel into the target cylinders;

an injector drive circuit to supply the drive currents to the plural injectors;

an injector control unit to supply injector drive signals, which control the drive currents, to the injector drive circuit;

an injector drive detection unit to generate injector drive confirmation signals corresponding to drivings of the plural injectors; and an injector drive abnormality judgment unit to judge, based on the injector drive confirmation signal, a drive abnormality of the injector corresponding to the injector drive confirmation signal, wherein the injector drive abnormality judgment unit judges an abnormality of the injector drive confirmation signals based on a state of the injector drive confirmation signals, wherein the injector drive detection unit outputs the injector drive confirmation signal in synchronization with the injector drive signal by the injector control unit, and wherein the injector drive detection unit generates the injector drive confirmation signal based on a surge voltage at a time of stop of the drive current supplied to the injector by the injector drive circuit.

2. The control apparatus for the vehicular internal combustion engine according to claim 1, wherein the injector drive abnormality judgment unit judges the state of the injector drive confirmation signals based on existence of a past injector drive signal corresponding to the injector drive signal generated from the injector control unit, and judges the abnormality of the injector drive confirmation signals.

3. The control apparatus for the vehicular internal combustion engine according to claim 1, wherein the injector drive abnormality judgment unit judges that when the injector drive confirmation signal is missed, the injector corresponding to the injector drive confirmation signal is abnormal in driving, and judges that when all the injector drive confirmation signals corresponding to the plural injectors are missed, the injector drive confirmation signals are abnormal.

4. The control apparatus for the vehicular internal combustion engine according to claim 3, wherein the injector drive signal from the injector control unit is stopped to stop fuel supply to the cylinder targeted by the injector judged to be abnormal in driving by the injector drive abnormality judgment unit, and the injector drive signal from the injector control unit is continued and fuel supply to the cylinder is continued when it is judged that the injector drive confirmation signals are abnormal.

5. The control apparatus for the vehicular internal combustion engine according to claim 3, wherein when it is judged by the injector drive abnormality judgment unit that the injector is abnormal in driving, the injector control unit stops output of the injector drive signal of the cylinder of a group to which the cylinder targeted by the injector judged to be abnormal in driving belongs.

* * * * *